United States Patent [19]

Fielder

[11] 4,351,401

[45] Sep. 28, 1982

[54] EARTH-BORING DRILL BITS

[75] Inventor: Coy M. Fielder, Salt Lake City, Utah

[73] Assignee: Christensen, Inc., Salt Lake City, Utah

[21] Appl. No.: 159,181

[22] Filed: Jun. 13, 1980

Related U.S. Application Data

[60] Division of Ser. No. 913,571, Jun. 8, 1978, Pat. No. 4,244,432, which is a continuation of Ser. No. 704,424, Jul. 12, 1976, abandoned.

[51] Int. Cl.[3] ..... E21B 10/46; E21B 10/56

[52] U.S. Cl. ..... 175/329; 175/410

[58] Field of Search ..... 175/329, 330, 410

[56] References Cited

U.S. PATENT DOCUMENTS

| | | | |
|---|---|---|---|
| 2,511,991 | 6/1950 | Nussbaum | 175/330 |
| 3,696,875 | 10/1972 | Cortes | 175/329 |
| 3,709,308 | 1/1973 | Rowley et al. | 175/329 |
| 3,885,637 | 5/1975 | Veprintseu et al. | 175/329 |
| 3,938,599 | 2/1976 | Horn | 175/329 |
| 4,073,354 | 2/1978 | Rowley | 175/329 |
| 4,098,363 | 7/1978 | Rohde | 175/329 |

*Primary Examiner*—James A. Leppink

*Attorney, Agent, or Firm*—Bernard Kriegel; Philip Subkow

[57] ABSTRACT

The invention relates to the design of earth bore-hole drill bits embodying shaped preformed cutters containing hard abrasive materials, such as diamonds, the cutters being mounted in companion preformed sockets in the hard metal bit matrix. The extent of penetration of the preformed cutters into the formation being drilled is controlled by providing surface set diamonds embedded in the matrix at or adjacent to its gage portion, the surface set diamonds projecting from the matrix to a much lesser extent than the preformed cutters. As a result, the surface set diamonds can penetrate into the formation only to the extent determined by engagement of the adjacent face of the matrix with the formation. Although the preformed cutters project from the matrix to a greater distance than the surface set diamonds, their extent of penetration into the formation is no greater than that of the surface set diamonds.

6 Claims, 13 Drawing Figures

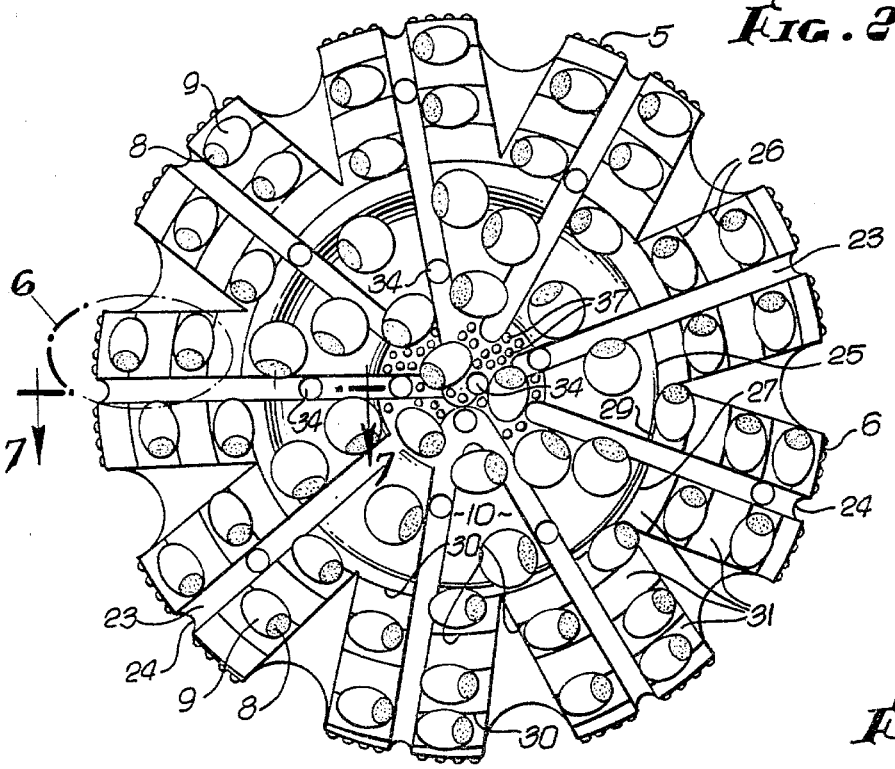
FIG. 2.
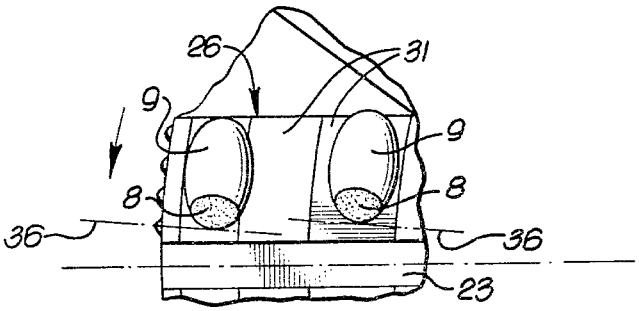
FIG. 6.
FIG. 7.
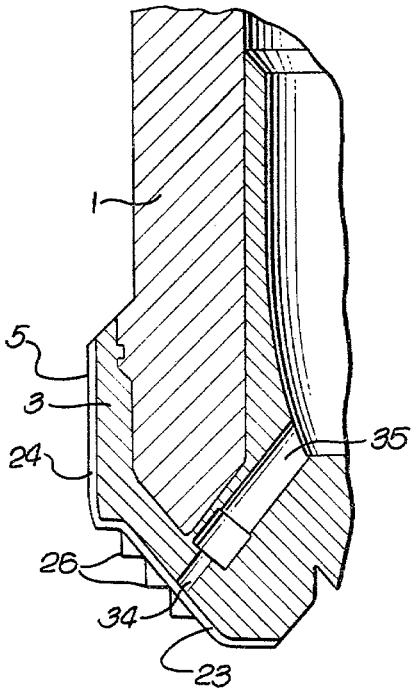

EARTH-BORING DRILL BITS

This application is a division of application Ser. No. 913,571, filed June 8, 1978, for "Earth Boring Drill Bits", now U.S. Pat. No. 4,244,432, which is a continuation of application Ser. No. 704,424, filed July 12, 1976, for "Earth-Boring Drill Bits", now abandoned.

BACKGROUND OF THE INVENTION

Diamond bits employing natural or synthetic diamonds positioned on the face of a drill shank and bonded to the shank in a matrix of a secondary abrasive, such as tungsten carbide, by means of a metal bond, are well known in the art.

There are two general types: One in which the diamonds usually of very small gage are randomly distributed in the matrix; another type contains diamonds, usually of larger size, positioned in the surface of the drill shank in a predetermined pattern, referred to as surface set. (see U.S. Pat. Nos. 3,709,308; 3,825,083; 3,871,840; 3,757,878; and 3,757,879.)

Drill bits formed according to the above procedure are subject to damage when used as bore-hole drill bits. Such damage results from localized destruction of the diamond matrix complex. When this occurs, the useful life of the bit may be terminated and salvage of the bit is required by separating the diamonds and tungsten carbide from the steel shank.

STATEMENT OF THE INVENTION

Instead of using individual diamond particles distributed either in random orientation in the secondary abrasive matrix, such as tungsten carbide with a metallic bonding agent, or as surface set bits, a cutter preform is employed. The cutter preform may be made as described in U.S. Pat. No. 3,745,623 or by molding mixtures of diamond particles, secondary abrasive particles, and particles of a metallic bonding agent employing the techniques of the above patents in suitable shaped molds, for example, by the hot press methods described in U.S. Pat. Nos. 3,841,852 and 3,871,840. A preform is preferred formed as in U.S. Pat. No. 3,745,623. According to the invention, the preforms are mounted in the body of the drill bit, such as described above, to be placed in spaced relation from the part adjacent to the central axis to close to gage of the bit. The arrangement of the preforms in the bit is such that on rotation of the bit about its axis, substantially the entire surface of the earth traversed by the bit on rotation is engaged by the preforms.

In order to assure that the preforms can cut without undue stress, the preforms are set at a negative rake and the preforms are backed by an adjacent portion of the body of the bit to take the thrust on the preform cutters imposed during drilling. Bending stresses are thus minimized, and, in a practical sense, avoided in the preforms.

Provisions are made to move the cuttings away from the preforms, the drilling fluid discharging from a fluid passage in the bit to provide a flushing action. For this purpose, channels are provided in fluid communication with the passage in front of the cutter preforms. The channels extend across the face of the bit from the central bore to the gage of the bit. While, for some uses, the channels may be omitted, the channels, as in our preferred embodiments, aid in establishing the bit hydraulics to clean the face of the bit and flush the cuttings from the drilling region. The cutters may be set with a zero but preferably with a negative side rake, so as to provide for a snowplow effect to move the cutting to the outer gage of the bit. The channels in the preferred embodiment extend in front of the cutter preforms which are oriented as described above. The orientation of the rake and the flow of fluid through the channels move the cuttings to the annulus between the bit and bore hole to be carried up the annulus to the surface. The preform cutters are carried in preformed sockets positioned in the base of the drill bit, preferably in a drill bit coated, for example, with metal-bonded secondary abrasives having a hardness value less than diamonds. Coating of the drill bit with such hard material is conventional, but in such case, the diamonds are mounted as described in the above patents. We prefer to prepare sockets in the drill, so oriented about the drill bit, and with the preforms so oriented in the sockets, as to give the pattern previously referred to.

The cutters according to our invention may be mounted in preformed sockets formed in the matrix-coated drill, so formed as to orient the preforms which are mounted by insertion into the sockets, to provide the pattern and rakes described above. Instead, the preforms may be mounted in receptacles positioned on studs which are inserted in sockets formed in the matrix-coated drill. The studs and sockets are formed so that on insertion of the studs in the receptacles, the preforms are oriented in the pattern and with the rakes described above.

It is preferred to use the bits carrying the studs in relatively soft formations and to use the preforms mounted directly in the sockets for hard formations.

The arrangements, both that employing preform cutters mounted on studs positioned in the sockets and the preforms mounted directly in the sockets formed in the face of the bit, have the advantage that the cutters may be backed so that they are in compression rather than in tension due to bending.

It is preferred to arrange the cutters in an array in the manner and for the purposes described above and more fully described below and to arrange the fluid channels to be positioned in front of the cutter arrays. This arrangement controls the flow pattern across the cutting surface in immediate proximity of the cutters and aids in removing cuttings and flushes them away from the cutters.

One of the avantages of the mounted preform cutters according to the invention is that, on destruction or other damages to a preform, the damaged preform may be removed and replaced without requiring the salvage of the entire bit.

The above design of the diamond bit of our invention is particularly suitable when using synthetic diamonds, such as are employed in the formation of the cutting elements described in U.S. Pat. No. 3,745,623. Such diamonds are weakened to a much greater degree than are natural diamonds at temperatures normally employed in production of drill bits by processes such as are described in U.S. Pat. Nos. 3,709,308; 3,824,083; and 3,757,879. Such processes entail exposing diamonds to temperatures which are used in the infiltration or hot press processes of the aforesaid patents. The temperatures employed in such procedures are in the order of above about 2000° F., for example, 2150° F. Such temperatures, while suitable for natural diamonds, are excessive for synthetic diamonds and weaken them excessively.

The design of the drill bit of the invention permits the use of synthetic diamonds as well as natural diamonds in that the preforms using synthetic diamonds or natural diamonds may be formed at temperatures suitable for synthetic diamonds as is described in said U.S. Pat. No. 3,745,623.

The design of the invention thus permits the formation of the drill bit body at high temperatures and the formation of the preforms when using natural diamonds by the high temperature methods previously described, or when using synthetic diamonds by forming them at lower temperatures, for example, as described in U.S. Pat. No. 3,745,623. Thus the preforms employing, for example, natural diamonds may be formed by the hot press method referred to in U.S. Pat. No. 3,871,840 employing molds of suitable shape to form the preform of the desired geometric configuration.

In some formations, preformed cutters of the bits may generate cuttings so rapidly that they cannot be removed quickly enough by the circulating fluid from the hole bottom. In soft ductile formations, preformed diamond cutters can generate cuttings much faster than they can be removed by the fluid, resulting in the bit balling and virtually ceasing its drilling action. With the present invention, the placing of natural surface set penetration control diamonds in the bit matrix, at or near the gage of the bit, can drastically reduce and control the extent of penetration of the preformed cutters into the formation and the rate at which such cutters can drill the hole, permitting the circulating fluid issuing from the bit an opportunity to flush the cutters clean and convey the cuttings to the gage portion of the bit and the upwardly through the annulus surrounding the drilling string. As a result, balling of the bit is prevented, the bit performance being greatly improved.

Other features and objects of the invention will be understood by reference to the drawings of which:

FIG. 2 is a plan view of the bottom of the bit taken on line 2—2 od FIG. 1;

FIG. 6 is a fragmentary detail of FIG. 2 showing the side rake;

FIG. 7 is a fragmentary section taken on line 7—7 of FIG. 2;

Figure 1:
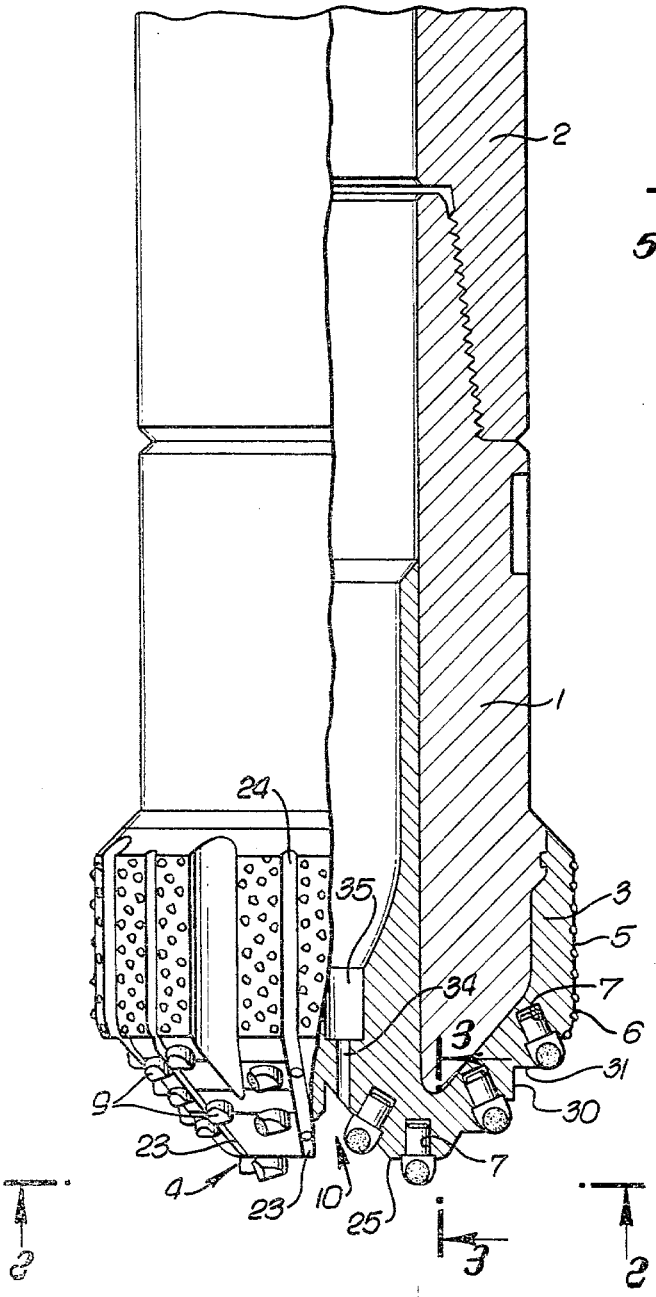
FIG. 1 is a view partly in elevation and partly in quarter section of an earth-boring bit according to our invention.

In the form of FIGS. 1–7, the tubular shank 1 of the bit is of conventional shape and is connected to the drill collar 2 and is coated internally and externally of the shank with a hard material 3, for example, such as metal-bonded tungsten carbide to form the face 4 of the bit section and the stabilizer section 5, as in prior art diamond drill bits used for earth bore-hole drilling. The hard coating 3 of the bit extends circumambiently about the central axis of the bit and is positioned between the gage 6 of the bit and across the face of the bit, the gage 6 being formed on the stabilizer section 5 of the hard coating.

Sockets 7 are positioned in the coating 3 spaced as herein described in the face 4 in accordance with a pattern for the purposes herein described. The cutters 8 are mounted in the receptacles 9 carried on studs 14 positioned in sockets 7. We prefer, especially where the cutters are mounted in studs as described below, to form the face of the bit in steps 26 extending circumambiently about the face of the bit, as is described in a copending application filed jointly with applicant and another, Ser. No. 745,087. As is shown in the copending application and in FIGS. 1, 2, 7 and 8, the steps extend as a spiral from an inner portion 10 of the bit 1 to the portion of the face of the bit adjacent the gage 6, as will be more fully described below. The sockets in the case of the bit shown in FIGS. 1–7, are formed in the angle between 1 and 31 on one step and the rise 30 of the adjacent step.

In the form shown in FIGS. 1–7, each of the cutters is positioned in a stud-mounted receptacle. The studs 14 are formed with a receptacle 9 whose axis 16 is at an obtuse angle to the central axis of the stud 14. The stud is formed of steel or material of similar physical properties and is coated with a hard surface coating 18 formed, for example, of material of the same kind as is used in the coating 3. The stud may be held securely in the socket by an interference fit or by brazing or other means of securing the stud in the socket.

Secured in the receptacles as by soldering or brazing are preform cutters 8 formed as described above. They may be of any desired geometric configuration to fit into the receptacle. For convenience, we prefer cylindrical wafers whose axial dimension is but a minor fraction of the diameter of the wafer. The acute angle 20 thus established a negative vertical cutting rake.

Figure 4:
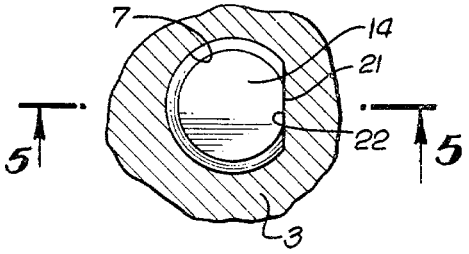
FIG. 4 is a section taken on line 4—4 of FIG. 3.
Figure 5:
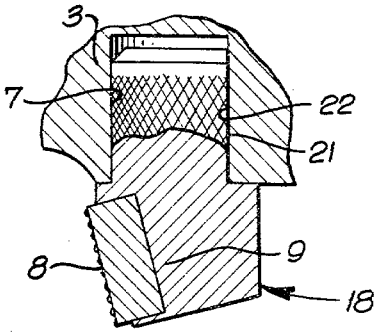
FIG. 5 is a section taken on line 5—5 of FIG. 4.

The studs 14 are provided with indexing means, for example, flat sections 21 (FIG. 4) so as to orient the studs, as is described below. Positioned in the sockets 7 are means which cooperate with indexing means on the studs, for example, the flat section 22 (FIG. 4). The indexing means are arranged to position the studs in a longitudinal array extending from adjacent the gage 6, across the face 4 towards the axis of the bit.

The aforesaid longitudinal array extends circumambiently about the bit spaced from each other as is illustrated in FIGS. 1 and 2. The arrays are separated by fluid channels 23 which extend from the central portion 10 of the bit to the gage 6 of the bit at the stabilizer section 5, where they join the vertical grooves or fluid channels 24. The studs are positioned in each array and are spaced from each other in each array. The cutters are arranged in each longitudinal array so that they are in staggered position with respect of the cutters in an adjacent array. The cutters in the arrays overlap each other in the sense that the portion of the earth, not traversed by a cutter of one array, is traversed by a cutter in the following array during rotation.

The indexing flats in the socket and stud are positioned so that the cutting face of the preform cutters in each array face in the same angular direction as the intended direction of rotation of the bit. The bit is designed for rotation in the usual manner by a clockwise rotation of the drilling string connected to the collar 2. This arrangement assures that all sections of the surface to be cut by the bit are traversed by a series of cutters during each revolution of the bit.

A convenient arrangement is to position the sockets and studs in a generally spiral configuration extending from the center of the bit to the gage.

Figure 8:
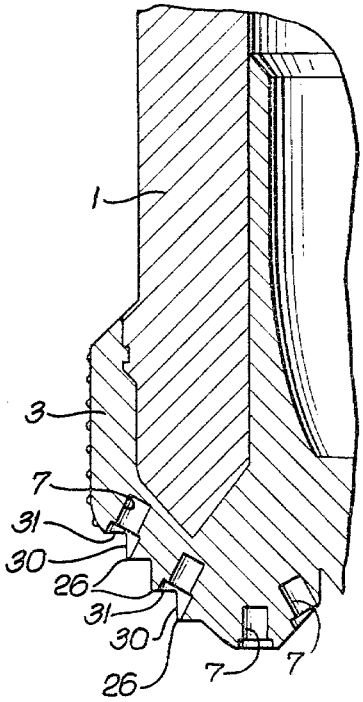
FIG. 8 is a section similar to FIG. 1 prior to installation of the studs.
Figure 12:
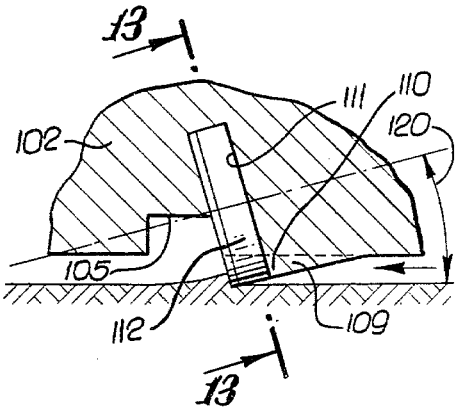
FIG. 12 is a section taken on line 12—12 of FIG. 11.

While the studs may be mounted in sockets formed in the face of the bit in any geometric form, for example, that shown in FIGS. 8 and 12, or in any form employed in the prior art, we prefer to mount the studs in sockets formed in the face as described and claimed in the copending application, Ser. No. 745,087.

In the form shown in FIGS. 1 and 2, the face is formed with a central portion 10 having a substantially circular perimeter 25. The portion of the face of the bit extending from the perimeter 25 to the gage 6 of the bit is formed with steps 26 in a spiral configuration. As is shown in FIG. 2, the spiral 27 starts at the tangent 29 at the rise 30 and traverses the face 4 as a spiral to form the lands 31.

The sockets 7 are formed in the face of the bit with the axis of each socket intersecting the apex of the angle between the rise and the land of each step. The geometry of this arrangement allows the bit to constitute a jig to assure that the sockets will be in a spiral configuration. The positioning of the studs in the angle between the rise and the land aids in the protection of the preform. Impact loads are absorbed by the lands and rises where the studs are located. As a result of this arrangement, on rotation of the bit, the preform cutter elements follow each other to cut the spaces which had been missed by the cutters of the preceding array. The result is that all portions of the earth are traversed by a series of cutters during each revolution of the bit.

In order to facilitate the cleaning of the bit and prevent clogging between the cutters, we provide, as described above, fluid channels 23 which join the grooves 24 in the stabilizer section 5. The fluid channels are in the form of grooves positioned between adjacent longitudinal arrays of cutters and extending adjacent to the face of the cutters in the array. Nozzles 34 (see FIGS. 1, 2 and 7) are positioned in the body of the face to connect with each channel. The nozzles are connected by bores 35 with the central tubular bore of the shank 1. They are positioned at various radial distances from the center around the bit in a generally spiral arrangement.

The flushing action of the fluid in the channels 23 may be sufficient to clean the cutters 8 and prevent clogging. In such case, the face of the cutters may be set at a zero rake, that is perpendicular to the direction of rotation, or with the negative side rake described below. Drilling fluid is discharged from the nozzles 34 into the channels or fluid courses 23 to flush cuttings through such channels and from the adjacent region of the bit, the flow of the cutting laden fluid continuing upwardly through the fluid courses 24 and along the stabilizer 5, and through the annulus between the drill string and the bore-hole wall to the surface.

Figure 3:
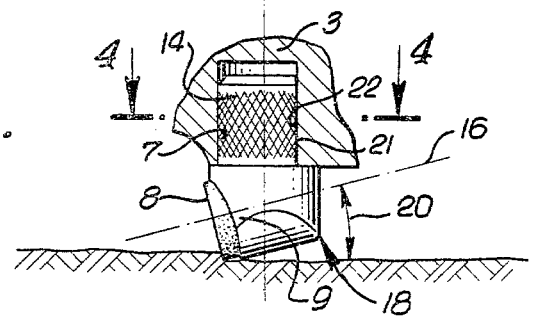
FIG. 3 is a fragmentary section taken on line 3—3 of FIG. 1 with parts in elevation.

To facilitate the discharge of the cuttings and to clean the bit, the cutters, in addition to the vertical negative rake 20 shown in FIG. 3, may be set in a horizontal rake as shown in FIG. 6. In order to assist in moving the cutting to the gage 6 of the bit, we prefer to orient the cutters so that the cutting surfaces of the preform cutters 8 are rotated about a vertical axis counterclockwise to provide a negative sideways rake 36 (see FIG. 6).

The negative horizontal rake angle 36 may be, for example about 1° to 10°, preferably about 20°. The effect of the negative sideways rake is to introduce a snowplow effect and to move the cuttings toward the gage of the bit where they may be picked up by the circulating fluid and carried up the grooves 24 of the stabilizer 5. The vertical negative rake angle 20 may be from about 4° to about 20°.

As will be seen, the space taken by the receptacle and the preforms makes impractical the positioning of a large multiple of preform cutting elements at the center of the bit. The problem is aggravated if any of the preforms are lost from the central portion because of damage occurring during use. It is preferred to supplement the cutting effect at the center by locating surface set diamonds 37, either in a pattern or in random distribution, in the central portion of the hard material 3. Surface set diamonds are also positioned in the matrix 3 at the gage 6 where the side impacts during drilling are large, employing conventional techniques in setting the diamonds as described above.

Through use of the infiltration method, such as described in U.S. Pat. No. 3,757,879, the hard metal coating or matrix 3 is cast on the shank 1, the casting operation also forming the steps 26, sockets 7, fluid courses 23, 24 and fluid passages 34, 35 in the matrix. At the same time, the diamonds 37 and diamonds **6*a*, 6*b* at the gage 5 are surrounded by and embedded in the matrix to securely fasten the diamonds thereto. The preformed cutters 8, 9** are then mounted in the sockets and secured therein.

One of the features of the above construction is that, should any one or more of the preform cutters be destroyed or the studs damaged, they may be removed; and a new stud and preform may be inserted.

The form of cutters of our invention, which is the presently preferred form, especially for use in hard formations, employs preforms mounted directly in position on the face of the bit.

Figure 9:
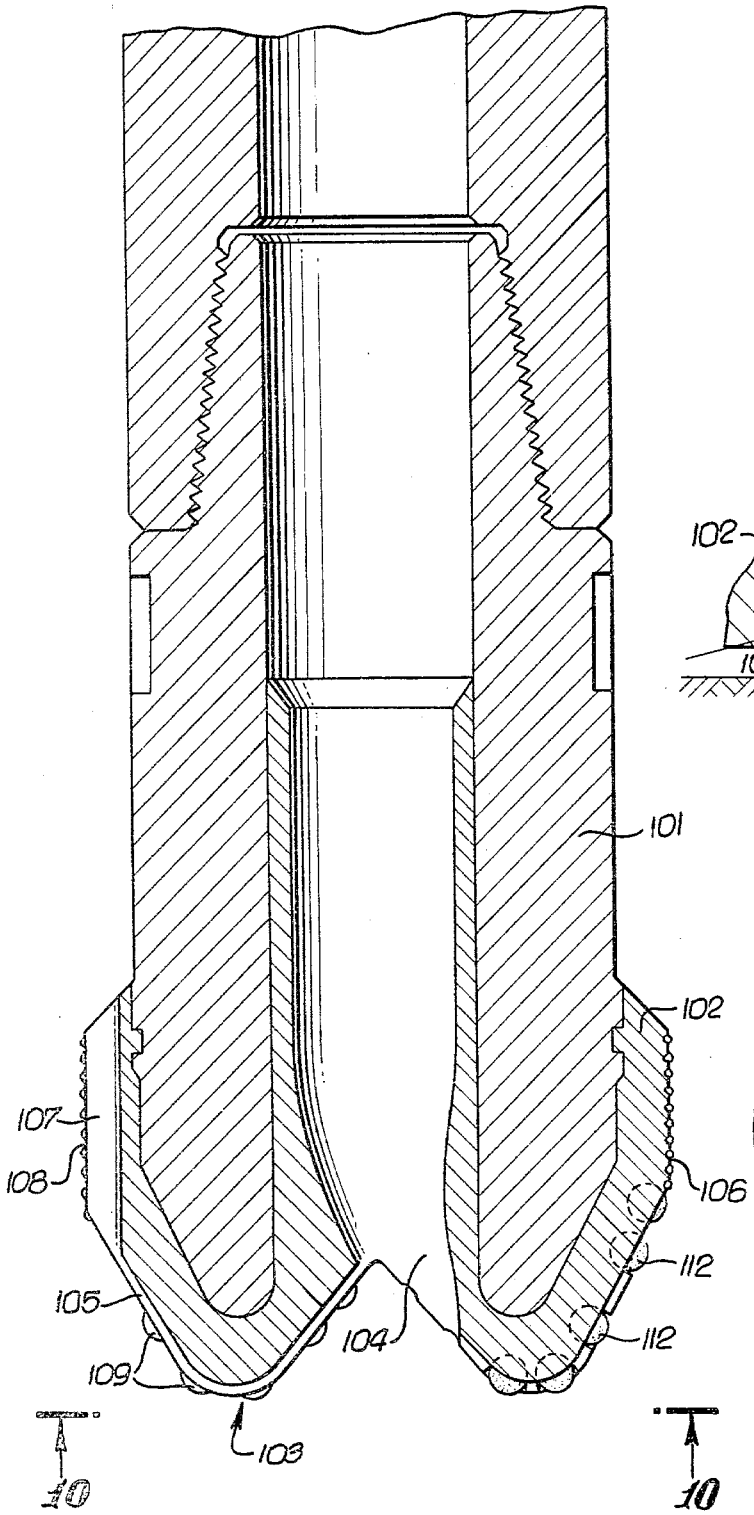
FIG. 9 is a vertical section of another form of a bit according to our invention.
Figure 10:
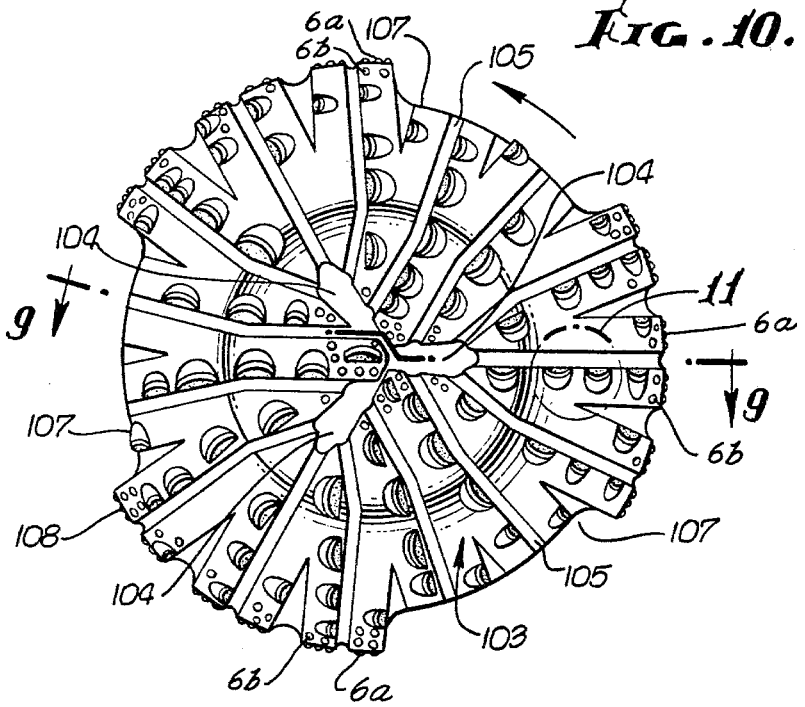
FIG. 10 is a plan view taken on line 10—10 of FIG. 9.

As shown in FIGS. 9 and 10, the bit is formed by a shank 101. coated as in the form of FIG. 1 by a hard coating 102. The face of the bit 103 is of generally conical shape faring into the central opening 104. As is shown in FIG. 10, the central opening may be the form of a threefold manifold with three branches 104 communicating with channels 105 extending to and communicating with the vertical grooves or fluid courses 107 in the stabilizer section 108 of the drill bit.

Figure 13:
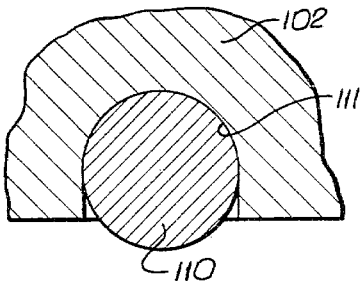
FIG. 13 is a section taken on line 13—13 of FIG. 12.
Figure 11:
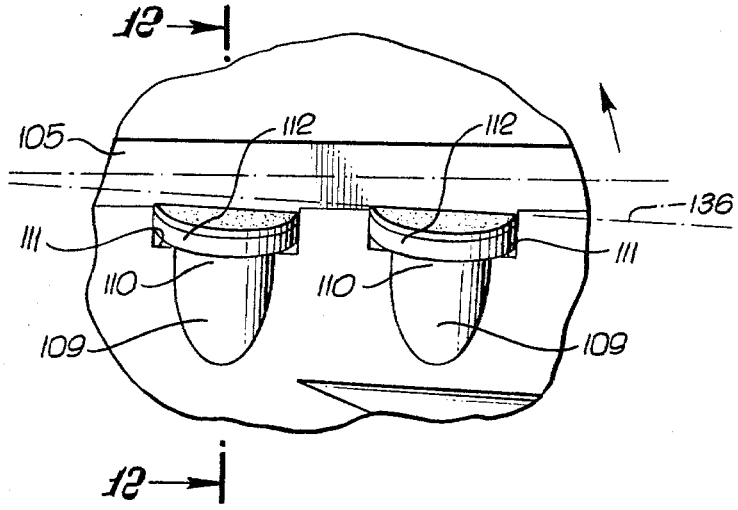
FIG. 11 is an enlarged fragmentary detail taken on line 11 of FIG. 10.

On the face of the bit are formed protuberances 109 spaced in longitudinal arrays about the face of the bit. Each of the protuberances has an extension 110 leading from a socket 111 in which is mounted a preform cutter 112 of the above composition, the protuberance and socket being preformed. As is shown in FIGS. 11, 12 and 13, the entire back of the preform is supported by the wall of the socket 111 and the extension 110 which acts as a receptacle to receive the preform.

As in the case of the cutters of FIGS. 1–7, the receptacles support the cutters with both vertical and horizontal rakes as is described for the cutters of FIGS. 1–7. As is shown in FIG. 12, the preform is mounted with a vertical negative rake 120 and, as is shown in FIG. 11, with a horizontal negative rake 136. The rake angles may be as described above for the forms of FIGS. 1–8. As is shown in FIGS. 10 to 12, the protuberances in the hard material extend from the periphery of the preforms 112 to the adjacent face of the bit.

The protuberances 109 are spaced in a longitudinal array from each other adjacent the channels 105, about the face of the bit. The protuberances and their contained receptacles are spaced from each other in arrays, as is described for the form of FIGS. 1–8. The cutters positioned in the receptacles in the protuberances are thus arrayed in a staggered overlapping arrangement with respect of the cutters in the protuberances in adjacent longitudinal arrays, similar to the arrangement of the stud supported preforms. The cutting surface of the cutters faces in the same angular direction as the direction of rotation of the bit. Fluid channels 105 are positioned in front of the array of cutters 112. The fluid which is fed through the central bore of the tubular drill shank 101 discharges into the manifold 104 and thus through the channel 105 and 107 to flush the cuttings, which have been moved towards the gage 106, upward into the surrounding annulus.

In both forms, the cutters are preforms which may be replaced as they are damaged or lost. They permit the cutters to be placed in receptacles formed in the hard coating of the diamond bit, in a predetermined array to efficiently cut an entire surface. The preforms may use fine primary abrasives such as diamonds or equivalent hard abrasive particles in a preform arranged in a predetermined array on the bit. The use of such preforms mounted in a pattern to cover substantially the entire surface to be cut, but which would permit replacement of individual damages cutters, has the advantage that a worn bit may be readily repaired and need not be discarded or require salvage. In order to permit the mounting or preforms which tend to be brittle in a bit where they will meet impact forces, the invention provides for a support which preserves the integrity of the preforms.

As previously noted, surface set diamonds 6*a*, 6*b* are positioned in the matrix 3 at the gage 6. As shown in FIG. 10, surface set control diamonds 6*a* are located in the matrix at the gage 6 itself. Others surface set diamonds 6*b* may be disposed immediately inwardly of the gage, the dimaonds 6*a*, 6*b* extending arcuately around and near the gage. If the design of the bit requires, a large number of such surface set diamonds 6*a*, 6*b* can be embedded in the matrix, the extent of projection of such diamonds from the matrix being much less than the extent of projection of the preformed cutters 112. Thus, the maximum penetration of the preformed cutters 112 into the formation is controlled by the extent of penetration of the surface set control diamonds 6*a*, 6*b* into the formation, before the matrix face of the bit engages the formation.

I claim:

1. An earth-boring bit comprising a metallic shank having a fluid passage, one end of said shank being coated with a hard material bonded to said end and forming a face of said bit, said hard material having a wear resistance substantially greater than that of said metallic shank, preformed sockets in said hard material of said face, preform cutters mounted in said sockets and extending to substantially the gage of the bit, each of said cutters including a plurality of abrasive particles bonded into a preform, and penetration control diamonds embedded in said hard material adjacent to the gage of the bit and extending around the gage of the bit, said control diamonds projecting from said hard material, the extent of projection of said control diamonds from said hard material being substantially less than the extent of projection of said preform cutters from said hard material.

2. An earth-boring bit comprising a metallic shank having a fluid passage, one end of said shank being coated with a hard material bonded to said end and forming a face of said bit, said hard material having a wear resistance substantially greater than that of said metallic shank, preform cutters mounted in said hard material and extending to substantially the gage of the bit, each of said cutters including a plurality of abrasive particles bonded into a preform, and penetration control diamonds embedded in said hard material adjacent to the gage of the bit and extending around the gage of the bit, said control diamonds projecting from said hard material, the extent of projection of said control diamonds from said hard material being substantially less than the extent of projection of said preform cutters from said hard material.

3. The bit of claims 1 or 2, said preform cutters comprising bonded diamond particles.

4. The bit of claims 1 or 2, said preform cutters comprising bonded synthetic diamond particles.

5. The bit of claims 1 or 2, said hard material being fabricated at above about 2000° F.

6. The bit of claims 1 or 2, a plurality of fluid channels positioned in said face and extending to the gage of said bit, said fluid channels communicating with said fluid passage, said fluid channels extending in front of said preform cutters.

* * * * *